US008118002B2

(12) United States Patent
Lee et al.

(10) Patent No.: US 8,118,002 B2
(45) Date of Patent: Feb. 21, 2012

(54) CONTINUOUSLY VARIABLE VALVE LIFT SYSTEM INCLUDING VALVE DEACTIVATION CAPABILITY ON ONE OF TWO DUAL INTAKE VALVES

(75) Inventors: Jongmin Lee, Pittsford, NY (US); Richard B. Roe, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 423 days.

(21) Appl. No.: 12/070,404

(22) Filed: Feb. 19, 2008

(65) Prior Publication Data

US 2009/0205595 A1 Aug. 20, 2009

(51) Int. Cl.
*F01L 1/34* (2006.01)

(52) U.S. Cl. ..... 123/90.16; 123/90.39

(58) Field of Classification Search ..... 123/90.39, 123/90.16; 74/559, 569
See application file for complete search history.

(56) References Cited

U.S. PATENT DOCUMENTS

| | | | | |
|---|---|---|---|---|
| 6,321,704 | B1 | 11/2001 | Church et al. | |
| 6,742,483 | B2 * | 6/2004 | Asakura | 123/90.16 |
| 6,932,035 | B1 * | 8/2005 | Shui et al. | 123/90.16 |
| 7,093,572 | B2 | 8/2006 | Hendriksma et al. | |
| 2004/0182340 | A1 * | 9/2004 | Cecur | 123/90.16 |
| 2006/0144356 | A1 * | 7/2006 | Sellnau et al. | 123/90.16 |
| 2007/0125329 | A1 | 6/2007 | Rohe et al. | |

* cited by examiner

*Primary Examiner* — Zelalem Eshete
(74) *Attorney, Agent, or Firm* — Thomas N. Twomey

(57) ABSTRACT

In a dual intake valve arrangement for an internal combustion engine, a continuously variable valve lift (CVVL) system controls two intake valves for one or more engine cylinders. In each cylinder, one of the intake valves includes an associated valve deactivation device, and the other intake valve does not. To improve in-cylinder air flow turbulence under low valve lift, one of the intake valves may be deactivated, resulting in mixture intake through only one valve, resulting in strong swirl by unbalanced flow. A CVVL-equipped engine including a valve deactivation device provides the same amount of air flow for the same engine load as a prior art CVVL engine. A method of introducing a swirl to the mixture is also described.

6 Claims, 3 Drawing Sheets

CONTINUOUSLY VARIABLE VALVE LIFT SYSTEM INCLUDING VALVE DEACTIVATION CAPABILITY ON ONE OF TWO DUAL INTAKE VALVES

TECHNICAL FIELD

The present invention relates to variable valve lift systems for internal combustion engines; more particularly, to a system for continuously variable lift of dual intake valves; and most particularly, to such a system wherein the valvetrain of one of the dual intake valves is further equipped with means for lost motion valve deactivation.

BACKGROUND OF THE INVENTION

Continuously variable valve lift systems are known in the engine arts. See, for example, the system disclosed in US Patent Application Publication No. 2007/0125329, published Jun. 7, 2007 and incorporated herein by reference. Such a system incorporates a crank mechanism for selective continuous variation of the contact point of a special rocker subassembly (RS) with the engine camshaft to vary the angular rotational motion of the RS. The RS is positioned between the engine camshaft and the valvetrain's roller finger follower (RFF). The RS includes a secondary cam surface followed by the RFF. Varying the contact point of the RS on the camshaft has the effect of varying the lift and the opening and closing timing of the associated engine combustion valve. For a cylinder having dual intake or dual exhaust valves, the RS comprises a wide secondary cam surface that is followed identically by the RFF for each valve.

Variable valve activation/deactivation (WA) systems are also known in the engine arts. See, for example, U.S. Pat. No. 6,321,704 that discloses a deactivating hydraulic lash adjuster (DHLA), and U.S. Pat. No. 7,093,572 that discloses a deactivating roller finger follower (DRRF), both of which are incorporated herein by reference. Each of these prevents the rotary motion of the camshaft lobe from being translated into reciprocal motion of the associated valve stem by absorbing the equivalent motion within itself ("lost motion"). Thus the valve is "deactivated" and prevented from opening on schedule.

For gasoline engines, compromises inherent with fixed valve lift and event timing of a conventional valve train have prompted engine designers to consider Continuously Variable Valve Lift (CVVL) systems for more flexible air flow control optimized for each engine load and speed condition. In recent years, some relatively basic forms of CVVL have been introduced into production engines. Greater performance and drivability expectations of customers, more stringent emission regulations set by government legislators, and the mutual desire for higher fuel economy are increasingly at odds. As a solution, some vehicle manufacturing companies are considering large-scale application of higher function CVVL mechanisms in their next generation vehicles, mainly to improve fuel economy, by reducing pumping loss, and cold start combustion stability, with increased cylinder air flow tumble motion. However, the CVVL engine has two critical engineering challenges for turbulence (swirl or tumble) enhancement and cylinder by cylinder valve lift variation, which requires combustion chamber masking for tumble enhancement and costly select fit of output rocker cam or roller finger followers for CVVL.

When applying a prior art CVVL system, current engine combustion strategies allow the intake valve to open from zero to full lift, as described above. However, the use of variable lift mechanisms has been limited on dual intake valves to the same lift on both valves of each cylinder, which cannot provide any in-cylinder air flow turbulence enhancement.

What is needed in the art is a CVVL system wherein in-cylinder turbulence is enhanced during variable-lift operation of an internal combustion engine, and especially under low lift flow conditions.

It is a principal object of the present invention to provide increased in-cylinder turbulence during variable-lift operation of an internal combustion engine.

SUMMARY OF THE INVENTION

Briefly described, in a dual intake valve system for an internal combustion engine, a CVVL system is provided for both intake valves for one or more engine cylinders. In each cylinder, one of the intake valvetrains includes a valve deactivation device such as a DHLA or a DRFF, and the other intake valvetrain includes a non-deactivating HLA and RFF. To improve in-cylinder air flow turbulence (mainly swirl) under low valve lift, one of the intake valves is deactivated by an external actuator system, resulting in intake air or air/fuel mixture through only one valve, which generates strong swirl by unbalanced flow because the open valve is off-axis of the cylinder.

In a presently preferred embodiment, a CVVL engine including a valve deactivation device provides the same amount air flow for the same engine load as a non-CVVL engine by providing higher valve lift (approximately 2 times the lift of a prior art CVVL-only maximum valve lift). The higher valve lift also reduces the impact of valve lift variation by component tolerance stack-up on engine performance to provide an expanded CVVL operating zone, and especially to extend the low lift limit zone.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

The present invention includes a CVVL system combined with a valve deactivation device. In each cylinder, one of the intake valvetrains is installed with a valve deactivation device whereas the other intake valvetrain is installed with a non-deactivating regular HLA and roller finger follower. To improve in-cylinder air flow turbulence (mainly swirl) under low valve lift conditions, one of the intake valves is deactivated by an external actuator system to provide air or fuel/air mixture entirely through the other valve, which generates strong swirl by unbalanced air flow. The CVVL engine combined with a valve deactivation device provides the same amount of air flow with higher valve lift for the same engine load. For conventional CVVL operation, the valve deactivation device is not operative and thus transmits the full lift generated by the output rocker cam to its associated valvetrain. For swirl enhancement purposes under low lift conditions, the valvetrain with the valve deactivation device is deactivated to keep the valve closed through lost motion within the valve deactivation device.

Figure 1:
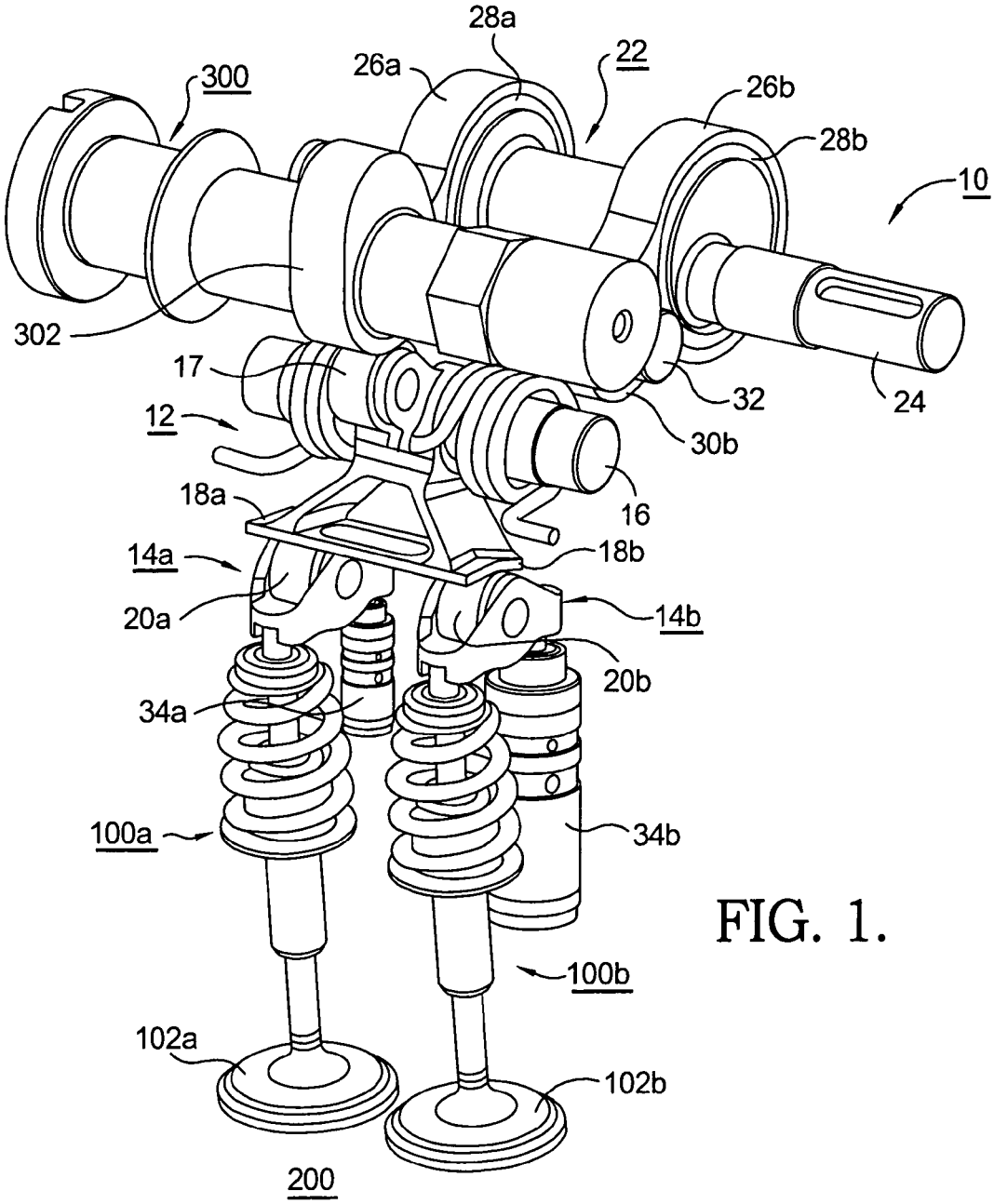
FIG. 1 is an isometric view of a first embodiment of a CVVL system and valvetrains in accordance with the present invention.

Referring to FIG. 1, a first CVVL system 10 in accordance with the present invention is shown for providing variable valve lift to first and second valvetrains 100*a*,100*b* which include first and second dual intake valves 102*a*,102*b* in an internal combustion engine 200. Engine 200 may be either compression ignited or spark ignited. Valvetrains 100*a*,100*b* are both actuated by a standard engine camshaft 300.

CVVL system 10 may take the form of a prior art system for variable valvetrain actuation, substantially as disclosed in US Patent Application Publication No. 2007/0125329 A1. Alternatively, a CVVL system 10 may take the form shown in FIG. 1, which is structurally similar and functionally identical to the previously disclosed system.

A rocker subassembly (RS) 12 is disposed between camshaft 300 and first and second rocker arms, shown herein as roller finger followers (RFFs) 14*a*,14*b* of valvetrains 100*a*, 100*b*. RS 12 is pivotable on or about RS shaft 16 and includes a roller 17 for engaging a lobe 302 of camshaft 300 and further includes first and second cam plates 18*a*,18*b* having output cam profiles that themselves engage the respective rollers 20*a*,20*b* of RFFs 14*a*,14*b*.

A RS-positioning crank subassembly (CS) 22 includes a crankshaft 24 supportive of first and second crank arms 26*a*, 26*b* rotatably disposed on non-rotatable circular throws 28*a*, 28*b* eccentrically mounted on crankshaft 24. Each of arms 26*a*,26*b* includes a nose 30 (only nose 30*b* visible in FIG. 1) for supporting a positioning shaft 32 pivotably attached to RS 12. Rotation of crankshaft 24 causes arms 26*a*,26*b* and positioning shaft 32 to be similarly rotated, causing RS 12 to be counter-rotated about shaft 16. This action alters the meeting angle at which roller 17 makes contact with cam lobe 302, which changes the degree of lift to be imparted by RS 12 to RFFs 14*a*,14*b*.

As camshaft 300 rotates counter-clockwise, the opening flank of cam lobe 302 pushes rocker roller 18 away, causing RS 12 to rotate in a counter-clockwise direction. As RS 12 rotates, it turns about the axis of shaft 16. Continued counter-clockwise rotation of RS 12 advances the output cam profiles ground into cam plates 18*a*,18*b*. The further that RS 12 is rotated counter-clockwise about shaft 16, the greater the lift imparted through RFFs 14*a*,14*b* to valvetrains 100*a*,100*b*. However, the total lift is governed by the action of CS 22 as described above.

Each RFF pivots on the ball shaped tip of a hydraulic valve lash adjuster (HLA) 34*a*,34*b* conventionally disposed in engine 200. HLA 34*a* is a conventional non-deactivating HLA. However, in accordance with the present invention, HLA 34*b* is a deactivating HLA in accordance with the prior art, permitting complete activation or deactivation of valvetrain 100*b* as may be desired.

Figure 2:
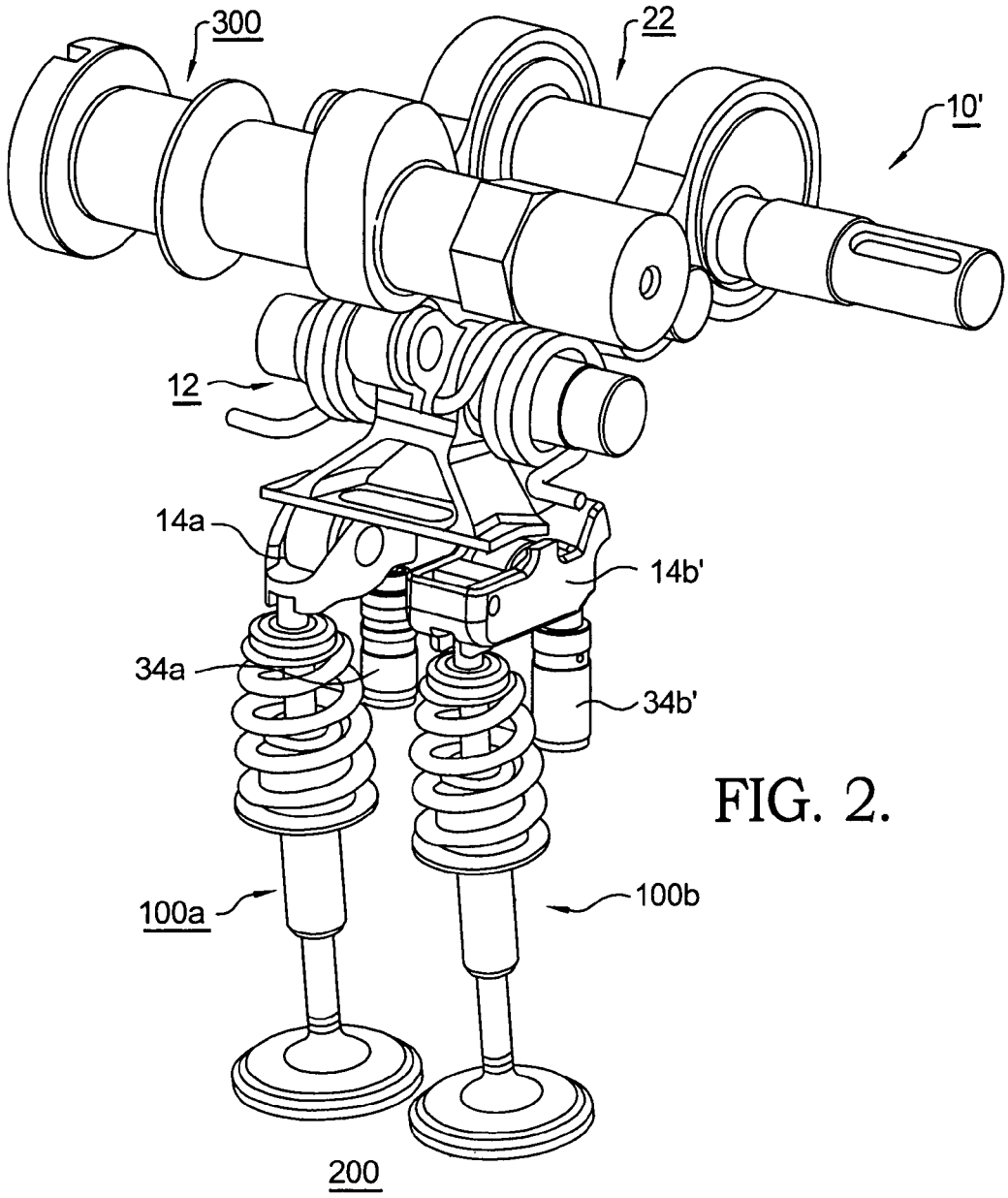
FIG. 2 is an isometric view of a second embodiment of a CVVL system and valvetrains in accordance with the present invention.

Referring to FIG. 2, the arrangement of a second embodiment 10' of a CVVL system in accordance with the present invention is identical in all respects to that just recited for first embodiment 10 except for the following:

a) both HLA 34*a* and 34*b*' are conventional non-deactivating HLAs; and b) RFF 14*b*' is a deactivating roller finger follower (DRFF) in accordance with the prior art.

It will be seen that the deactivation of valvetrain 100*b* can be carried out to equal effect by either embodiment 10 or embodiment 10', or any other method of valve deactivation such as, by way of example, a deactivating hydraulic lash adjuster.

Figure 3:
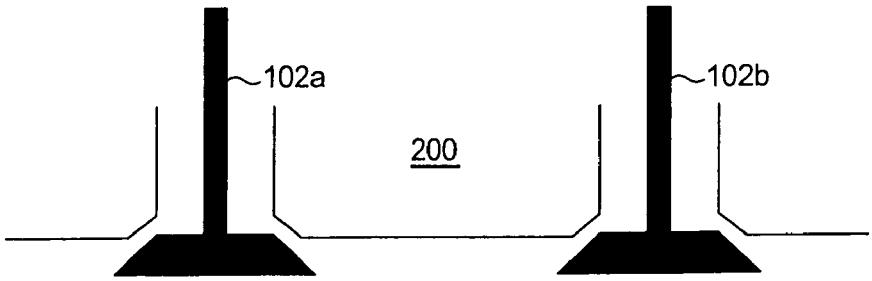
FIG. 3 is a schematic drawing of first and second valves in a dual intake-valve engine having CVVL capability.
Figure 4A:
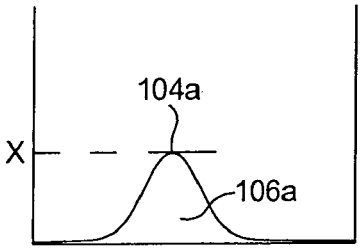
FIGS. 4*a* and 4*b* respectively are schematic lift curves for the corresponding valves shown in FIG. 3, showing a nominal maximum lift of 1×.
Figure 4B:
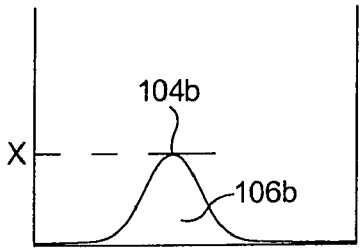

Referring to FIGS. 3 through 4*b*, in a prior art CVVL system when applied to dual intake valves 102*a*,102*b* in a head for an engine 200, the lifts 104*a*,104*b* of the valves are typically identical, as are the areas 106*a*,106*b* under the lift curve. The maximum obtainable lift with a prior art CVVL system is shown arbitrarily as x for each valve. Under conditions of low flow rate of air or air/fuel mixture through the valves, the valve lift is relatively small. Thus air flow into the engine is relatively low in volume and velocity, and is symmetrically balanced between the two valves, resulting in low mixing swirl within the cylinder. Because the resulting mixture homogenization within the cylinder is less than desirable, engine performance is also less than ideal over at least a portion of the range of engine operating conditions.

Figure 5:
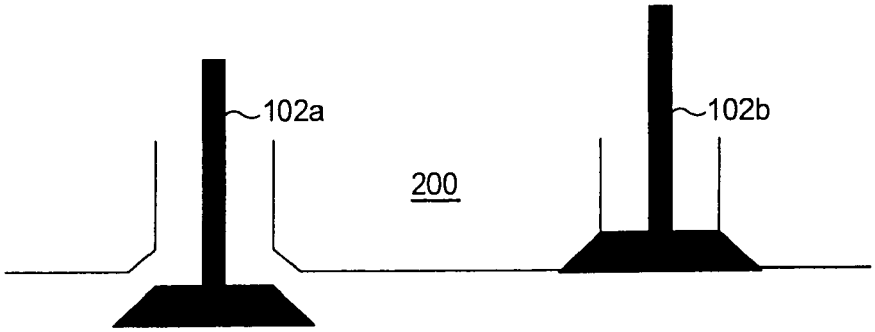
FIG. 5 is a schematic drawing of first and second valves in a dual intake-valve engine having CVVL and valve deactivation capability in accordance with the present invention.
Figure 6A:
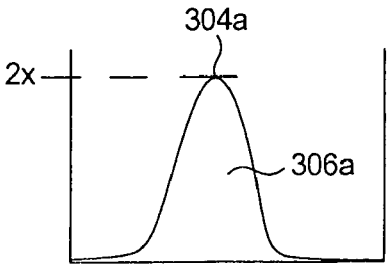
FIGS. 6*a* and 6*b* respectively are schematic lift curves for the corresponding valves shown in FIG. 5, showing a nominal maximum lift of 2× for the valve without deactivation capability and full closure of the other valve when deactivated.
Figure 6B:
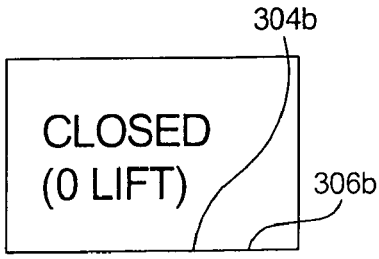

Referring to FIGS. 5 through 6*b*, in a CVVL and deactivation system in accordance with the present invention when applied to dual intake valves 102*a*,102*b* in a head for an engine 200, the lifts 304*a*,304*b* of the valves are non-identical, as are the areas 306*a*,306*b* under the lift curves. Under conditions of low flow rate of air or air/fuel mixture through the valves, the operating valve lift of the non-deactivating valve 102*a* is greater than the corresponding operating lift shown in FIG. 3, being preferably twice as great (2×). The greater lift is readily provided by adjusting the grinding profile of cam plates 18*a*,18*b* (FIGS. 1 and 2). (Further, the profiles of the two cam plates may differ if desired.) Thus air flow into the engine can be entirely though a single off-center valve, resulting in desirably greater mixing swirl within the cylinder, for the same amount of air flow into the cylinder, under low air flow conditions.

Because the activation or deactivation of second valvetrain 100*b* is independently controlled from the action of CS 22 (FIGS. 1 and 2), at full throttle both valves can be activated and opened 2× if so desired. All intermediate flows are possible by combining variable lift of first and second valves 102*a*,102*b* with activation/deactivation of second valve 102*b*. Thus, the range of flows and corresponding lifts is greater than those of a prior art CVVL system without valve deactivation on one of the dual valves, providing improved engine combustion at a wide variety of engine operating conditions.

In this manner, air flow turbulence such as swirl can be introduced into the cylinder for improved combustion. For example, at a time when it is desirous to introduce a swirl to the mixture charge entering the combustion chamber, only one of the two intake valves may be opened, as shown in FIGS. 5, 6*a* and 6*b*, permitting the same amount of charge to enter the chamber but the charge entering from only one side of the chamber to introduce the swirl.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for variable actuation of first and second intake valves of a cylinder in an internal combustion engine having a camshaft, comprising:

a) a continuously variable valve lift system for variably transmitting motion of a camshaft lobe to said first and second valves; said continuously variable valve lift system including a rocker subassembly pivotable about a rocker subassembly shaft, a rocker subassembly positioning crank supporting a positioning shaft that is pivotably attached to said rocker subassembly, wherein rotation of said rocker subassembly positioning crank causes counter-rotation of said rocker subassembly shaft, thereby altering the angle at which said rocker subassembly contacts said camshaft; and b) a valve deactivating device associated with only one of said first and second valves for selective activation and deactivation of said one valve.

2. A system in accordance with claim 1 wherein said valve deactivating device is a deactivation hydraulic lash adjuster.

3. A system in accordance with claim 1 wherein said valve deactivating device is a deactivating rocker arm.

4. A system in accordance with claim 3 wherein said deactivating rocker arm is a deactivating roller finger follower.

5. A system in accordance with claim 1 wherein control of said selective activation and deactivation of said one valve is independent of said continuously variable valve lift system.

6. An engine in accordance with claim 1 wherein said engine is selected from the group consisting of compression ignited and spark ignited.

* * * * *